US006836250B2

(12) United States Patent
Dai et al.

(10) Patent No.: US 6,836,250 B2
(45) Date of Patent: Dec. 28, 2004

(54) MICROSTRIP ANTENNA

(75) Inventors: Hsin Kuo Dai, Tu-chen (TW); Hsiang-Hue Shen, Tu-chen (TW); Kun Te Cheng, Tu-Chen (TW); Lung-Sheng Tai, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/315,799

(22) Filed: Dec. 9, 2002

(65) Prior Publication Data

US 2004/0012534 A1 Jan. 22, 2004

(30) Foreign Application Priority Data

Jul. 18, 2002 (TW) ..... 91210915 U

(51) Int. Cl.[7] ..... H01Q 1/38; H01Q 9/16

(52) U.S. Cl. ..... 343/700 MS; 343/793; 343/795

(58) Field of Search ..... 343/700 MS, 795, 343/793, 906, 830; H01Q 1/38, 9/16

(56) References Cited

U.S. PATENT DOCUMENTS

| | | | | | |
|---|---|---|---|---|---|
| 4,737,797 | A | * | 4/1988 | Siwiak et al. | 343/859 |
| 5,229,777 | A | * | 7/1993 | Doyle | 343/700 MS |
| 6,150,984 | A | * | 11/2000 | Suguro et al. | 343/702 |
| 6,337,666 | B1 | * | 1/2002 | Bishop | 343/795 |
| 6,342,868 | B1 | * | 1/2002 | Tsai et al. | 343/795 |
| 6,621,464 | B1 | * | 9/2003 | Fang et al. | 343/795 |

* cited by examiner

*Primary Examiner*—Don Wong
*Assistant Examiner*—Trinh Vo Dinh
(74) *Attorney, Agent, or Firm*—Wei Te Chung

(57) ABSTRACT

A microstrip antenna structure (1) for used in broadband, multi-frequency range applications includes a dipole antenna (2) comprising two dipole elements (21, 22), a dielectric substrate (3) on which the dipole elements are symmetrically disposed, and a feeding system (5) connected with the dipole antenna. Each dipole element comprises a triangular patch (211 or 221) and a V-shaped tentacle patch (212 or 222) extending from the triangular patch. The two dipole elements together form a butterfly structure antenna. This butterfly structure allows the dipole antenna to operate efficiently in a broadband range in the 2.4–2.5 GHz, 5.15–5.35 GHz and 5.45–5.75 GHz frequency bands.

18 Claims, 11 Drawing Sheets

Antenna Horizontal to
Horn Vertical(H-V)

Antenna Vertical to
Horn Horizontal(V-H)

Scale:5dBi/div
Horizontal Antenna-Vertically polarized radiation

Scale:5dBi/div
Horizontal Antenna-Horizontally polarized radiation

Scale:5dBi/div
Horizontal Antenna-Vertically polarized radiation

Scale:5dBi/div
Horizontal Antenna-Horizontally polarized radiation

Antenna Gain Over All Performance:Mock up

| AvgGain(Ant-Hom)dBi | 2.40GHz | 2.45GHz | 2.50GHz | 5.15GHz | 5.25GHz | 5.35GHz | 5.45GHz | 5.60GHz | 5.75GHz |
|---|---|---|---|---|---|---|---|---|---|
| H-H | -5.381 | -5.264 | -5.375 | -6.123 | -5.972 | -5.101 | -3.373 | -4.006 | -0.4045 |
| H-V | -10.971 | -8.960 | -7.098 | -10.413 | -12.216 | -13.058 | -13.417 | -14.767 | -15.114 |
| AVG of Ant(H) | -4.322 | -3.720 | -3.141 | -4.748 | -5.047 | -4.456 | -2.963 | -3.656 | -3.718 |
| V-H | -4.922 | -3.392 | -2.957 | -7.922 | -9.645 | -10.253 | -11.163 | -13.105 | -14.418 |
| V-V | -1.552 | -1.468 | -1.860 | -0.415 | -0.668 | -0.199 | 0.507 | -0.483 | -0.748 |
| AVG of Ant(V) | 0.092 | 0.386 | 0.636 | 0.295 | -0.150 | 0.210 | 0.793 | -0.252 | -0.565 |

FIG. 8

MICROSTRIP ANTENNA

BACKGROUND OF THE INVENTION

1. Field of the Invention

The present invention generally relates to planar antennas. More specifically, the present invention relates to a dipole microstrip antenna for use in wideband applications, which provides a wider operating bandwidth and capability in Ultrahigh Frequency (UHF) and Superhigh Frequency (SHF) bands.

2. Related Art

Wireless communication devices are now becoming commonplace in the electronics industry. Wireless networking of portable computers and associated devices is now replacing a large segment of the networking market. Wireless communication devices, including wireless networking adapters, hubs and other equipment, utilize radio transmitters and receivers to transmit data signals from one device or node to another. These radio transmitters and receivers have to utilize a specific frequency band and protocol to accomplish this task. Since these wireless networks and communications areas may often overlap, standards, protocols and privacy protection are necessary. One current standard in the industry has been established by the Institute of Electrical and Electronics Engineers, Inc. (IEEE) and is known as IEEE 802.11. It is a family of specifications for wireless local area networks (WLANs). There are currently four specifications in the family: 802.11, 802.11a, 802.11b, and 802.11g, all operating in the 2.4 GHz band, except for 802.11a, which operates in the 5 GHz band.

Another standard in wireless communications and networking is known as Bluetooth and is being established by a collaborative group of communications and computer companies. Devices incorporating Bluetooth technology can utilize a micro-chip transceiver for communication between devices. Bluetooth technology promises to be a viable and economical networking solution for interconnection of cell phones, computers, printers, modems, computer peripherals, fax machines and other communications and computing devices. The size of the Bluetooth transceiver can make it usable in devices as small as palmtop computers and cell phones.

Antennas are well known for enabling and improving transmission from radio transmitters and to radio receivers. Antennas can dramatically increase the range of radio transceivers. However, most antenna designs function best when protruding from their host device. In small electronic devices, protruding antennas are often vulnerable to breakage as the devices are often stowed in purses, pockets, backpacks and other areas where damage can occur.

Known microstrip antennas made of metal traces are lightweight, low profile, low cost devices suitable for replacing many of the more bulky antennas. Conventional microstrip antennas have an inherently narrow frequency bandwidth that limits more widespread usage. Numerous attempts to increase this bandwidth have attained little success. For example, U.S. Pat. No. 4,737,797, entitled "Microstrip Balun-Antenna Apparatus" discloses a balun planar antenna. The planar antenna apparatus includes a butterfly microstrip antenna printed on one side of a substrate and a balun input strip transmission line printed on two sides of the substrate using a conventional printed circuit process. The transmission line is coupled to the butterfly microstrip antenna via a balancing section. The operating center frequency of this antenna is 1.7 GHz and the bandwidth is 400 MHz. A length of a rectangular loop of the balancing section is 1.7 cm. If the additional length of the balun input strip transmission line is taken into account, the size of the antenna is still too large for a small communications transceiver, such as a mobile telephone.

Previous wide-band antennas, such as the horn, helix and log periodical antennas, all suffer from being bulky, heavy and nonconformal. Therefore, it is desired to combine the best characteristics of the microstrip and wideband antennas into one antenna.

SUMMARY OF THE INVENTION

It is an object of the present invention to provide a microstrip antenna structure which has a small antenna length, is high in efficiency and is usable over a wide band in multi-frequency ranges.

To achieve the above objects, a microstrip antenna structure in accordance with a preferred embodiment of the present invention includes a dipole antenna comprising two dipole elements spaced apart from each other, a dielectric substrate on which the dipole elements are symmetrically disposed, and a feeding system connected with the dipole antenna. Each dipole element comprises a triangular patch and a tentacle patch extending therefrom. The two dipole elements are mounted together to form a butterfly structure antenna. The butterfly structure provides the dipole antenna with an excellent broadband range at multiple frequencies.

These and additional objects, features and advantages of the present invention will become apparent after reading the following detailed description of a preferred embodiment of the invention taken in conjunction with the appended drawings.

BRIEF DESCRIPTION OF THE DRAWINGS

FIG. 8 is a table showing the gain results of the antenna structure of FIG. 1 as a measure of over all performance.

DETAILED DESCRIPTION OF THE INVENTION

Figure 1:
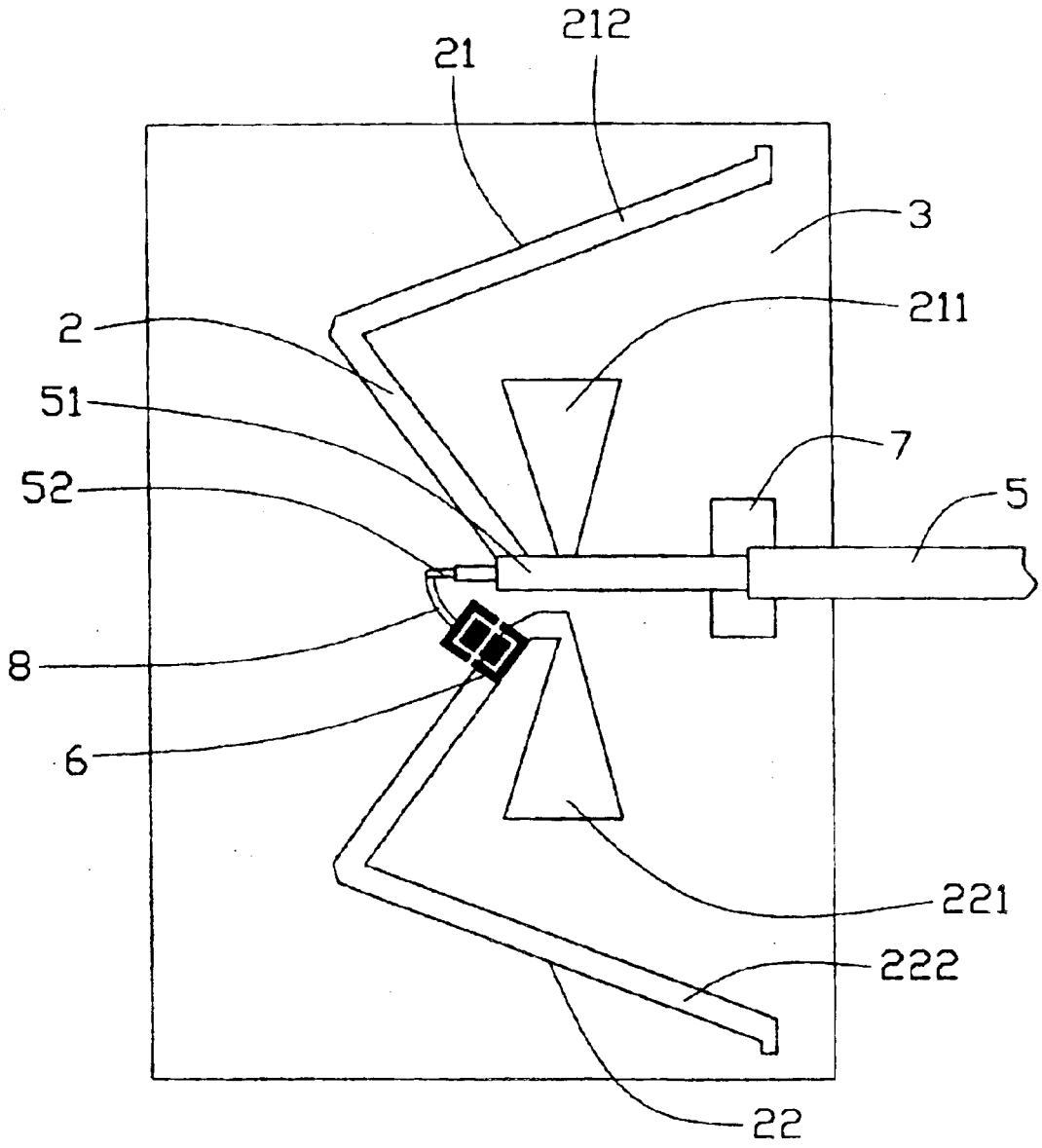
FIG. 1 is a top plan view of a microstrip antenna structure in accordance with a preferred embodiment of the present invention.
Figure 2:
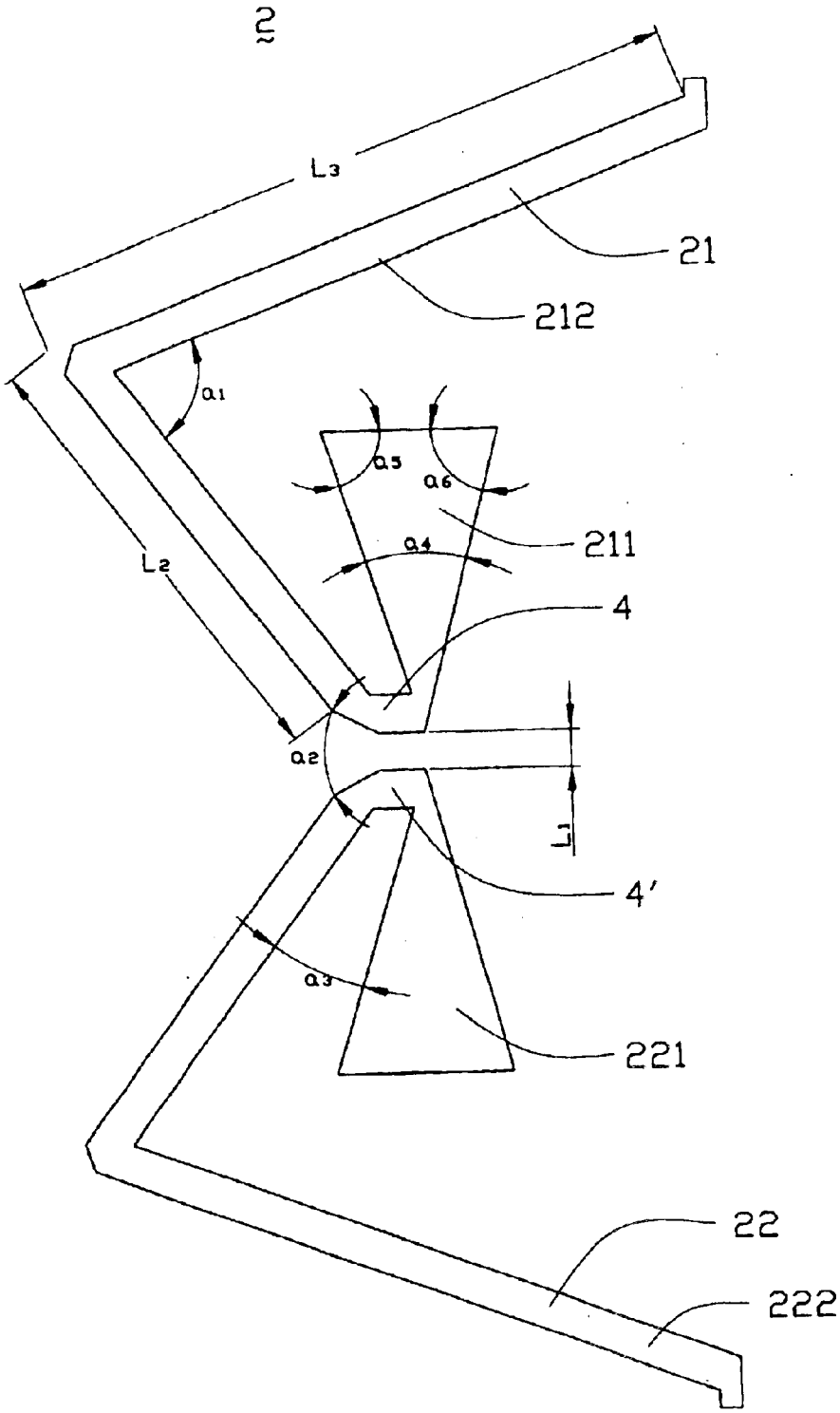
FIG. 2 is a plan view of a dipole antenna of FIG. 1.

Referring to FIGS. 1 and 2, a microstrip antenna structure 1 of the present invention includes a dipole antenna 2 mounted on a substrate 3 of dielectric material and a feeding system 5, which is a coaxial electric cable. In a preferred embodiment of the invention, the substrate 3 is a flexible printed circuit board (FPC).

The dipole antenna 2 has two dipole elements 21, 22 which are substantially the same as each other and symmetrically positioned on a same surface of the substrate 3 to form a butterfly structure.

The dipole element 21 is made from copper cladding, and comprises a triangular patch 211 with three respective angles of $\alpha 4$, $\alpha 5$, $\alpha 6$, and a V-shaped tentacle patch 212 with an angle of $\alpha 1$. One end of the triangular patch 211 abuts against the tentacle patch 212.

The dipole element 22 is a mirror image of the dipole element 21, and also comprises a triangular patch 221 and a V-shaped tentacle patch 222. Both dipole elements 21, 22 are located upon a same surface of the substrate 3 and are spaced apart from each other, and respective sides of their triangular patches 211, 221 are substantially parallel to each other. In addition, feeding points 4, 4' are provided at the connection between the corresponding triangular patches 211, 221 and the tentacle patches 212, 222.

The sizes and angles $\alpha 4$ of triangular patches 211, 221 determine the usable frequency range of the microstrip antenna 1. The sizes determine the frequency band, and the angles $\alpha 4$ affect the impendence matching characteristic of the microstrip antenna 1. Furthermore, the tentacle patches 212, 222 further affect the impendence matching characteristic of the microstrip antenna 1 by a change in the V-shaped inclination $\alpha 1$.

The feeding system 5 is fixed to the substrate 3 through a pad 7 and comprises an outer shield conductor 51 and a coaxial core conductor 52. The outer shield and inner core conductors 51, 52 are connected to the feeding points 4, 4', respectively.

The dipole antenna 2 itself is a balanced system, but the feeding system 5 breaks this balance. In other words, the impendence of the dipole antenna 2 is not matched to the feeding system 5. A multi-layer ceramic chip capacitor (MLCC) 6 is needed for restoring the balance. One end of the MLCC 6 connects to the feeding point 4', and a second end thereof connects to the inner conductor 52 of the feeding system 5 by a wire 8.

The structural parameters of the antenna shown in FIGS. 1 and 2 are as follows:

$L1=1$ mm, $L2=8.17$ mm, $L3=4.54$ mm, $\alpha 1=\alpha 5=75°$, $\alpha 2=165°$, $\alpha 3=19°$, $\alpha 4=32°$, $\alpha 6=74°$ The length and width of the antenna are 32.14 mm and 14.35 mm, respectively.

Figure 3:
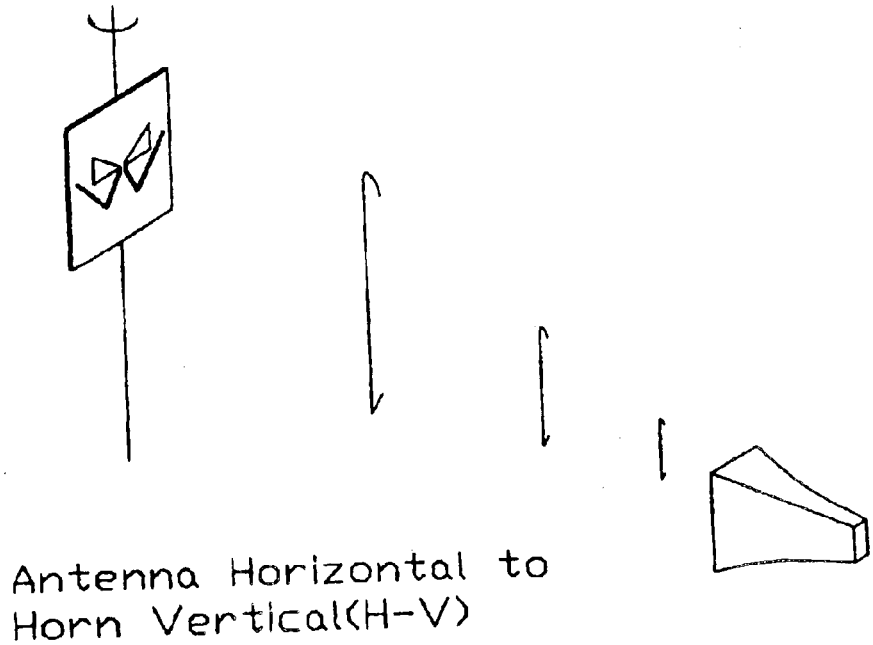
FIG. 3 is a diagram defining a H-V relative orientation between the antenna structure of FIG. 1 and a polarized beam of incoming radiation during gain measurements of the antenna structure of FIG. 1.
Figure 4:
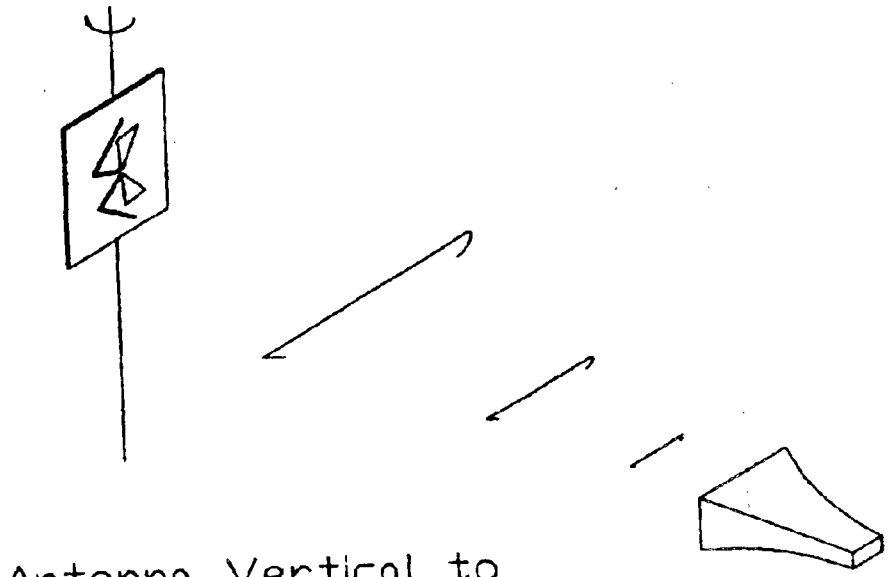
FIG. 4 is a diagram defining a V-H relative orientation between the antenna structure of FIG. 1 and a polarized beam of incoming radiation during gain measurements of the antenna structure of FIG. 1.
Figure 5B:
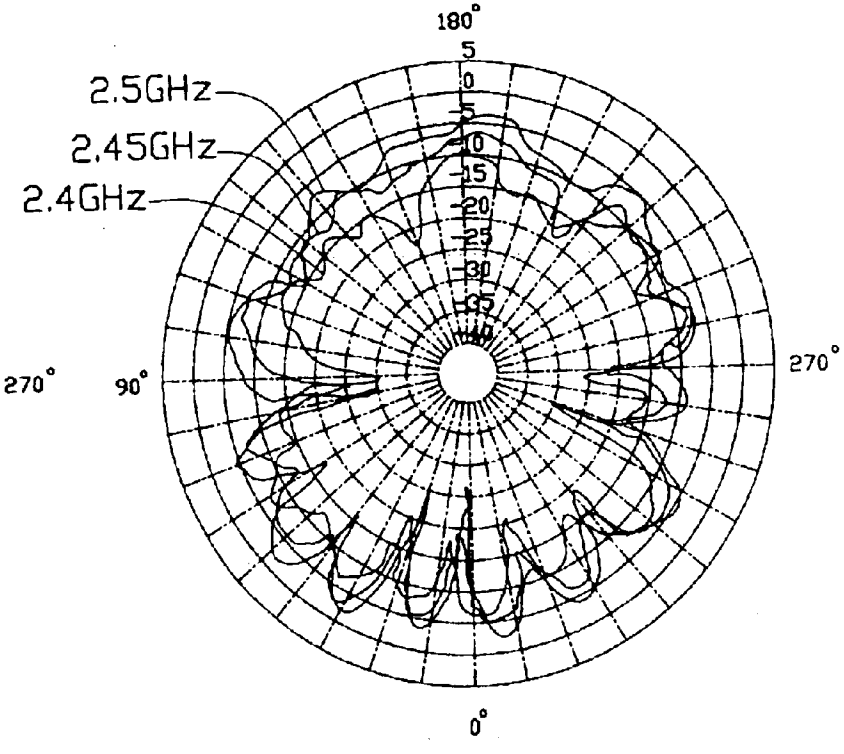
FIGS. 5A to 5D are graphs showing radiation patterns of the antenna structure of FIG. 1 operating at 2.4 GHz–2.5 GHz.
Figure 5A:
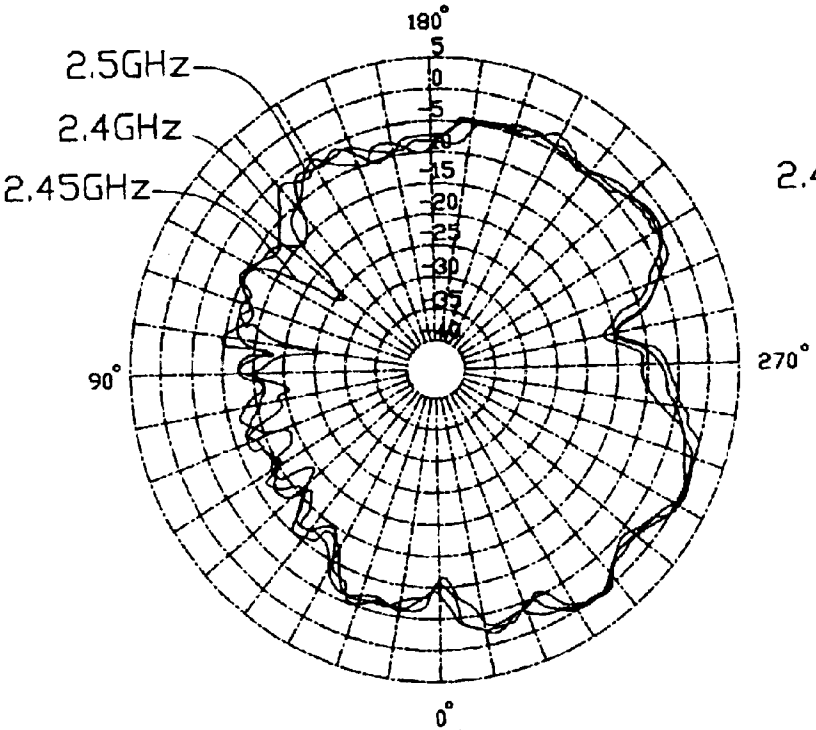
Figure 5D:
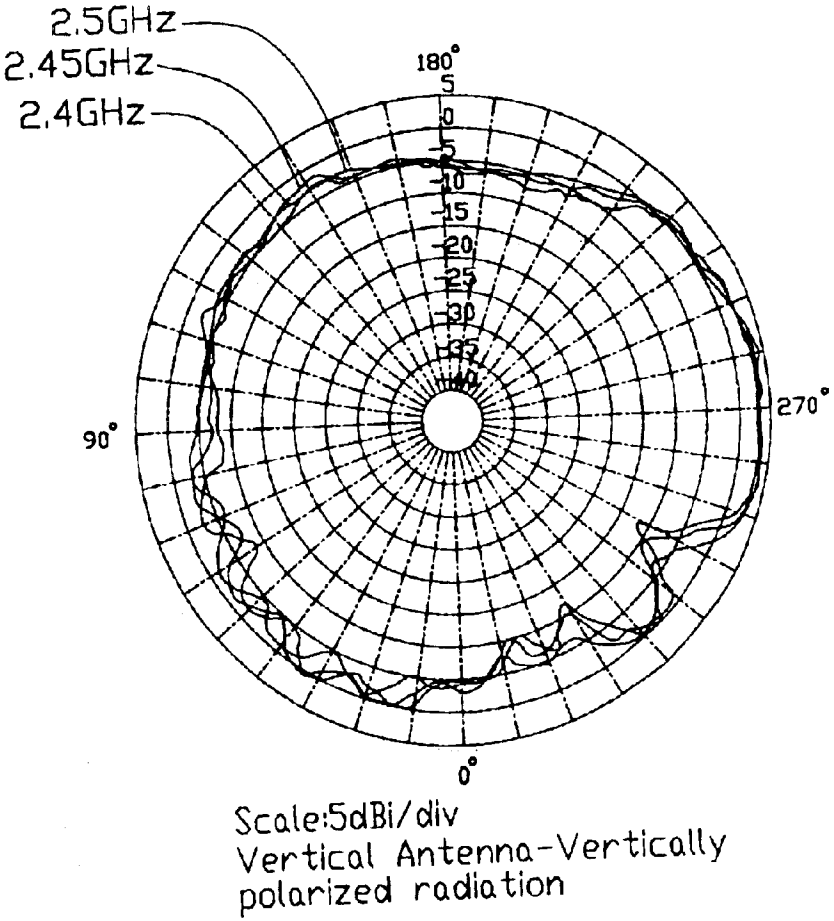
Figure 5C:
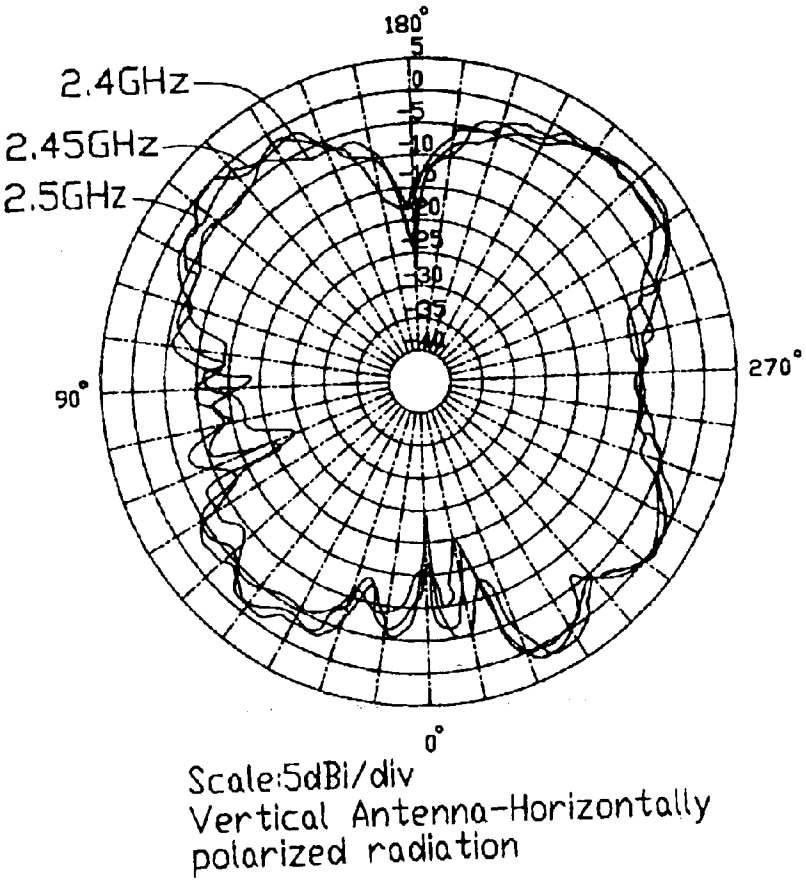
Figure 6B:
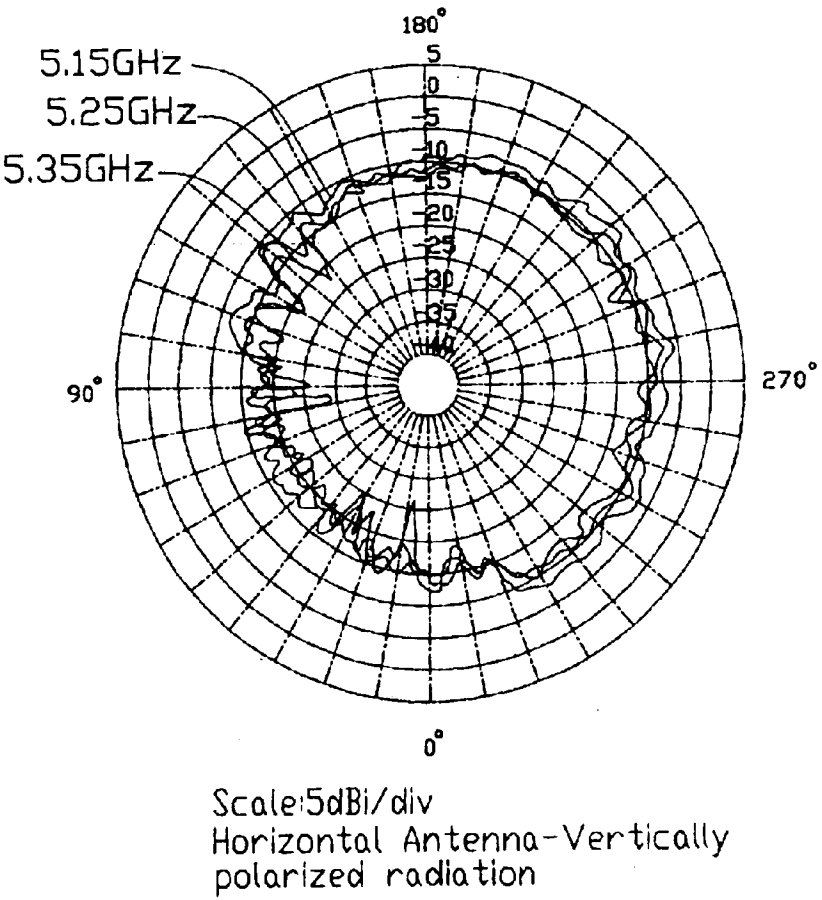
FIGS. 6A to 6D are graphs showing radiation patterns of the antenna structure of FIG. 1 operating at 5.15 GHz–5.35 GHz.
Figure 6A:
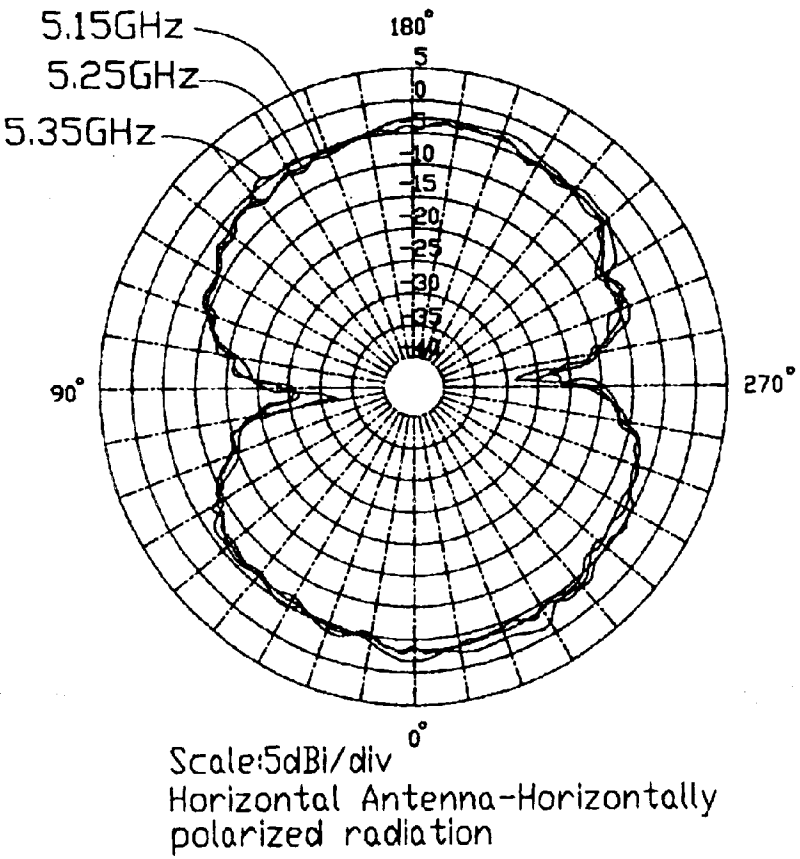
Figure 6D:
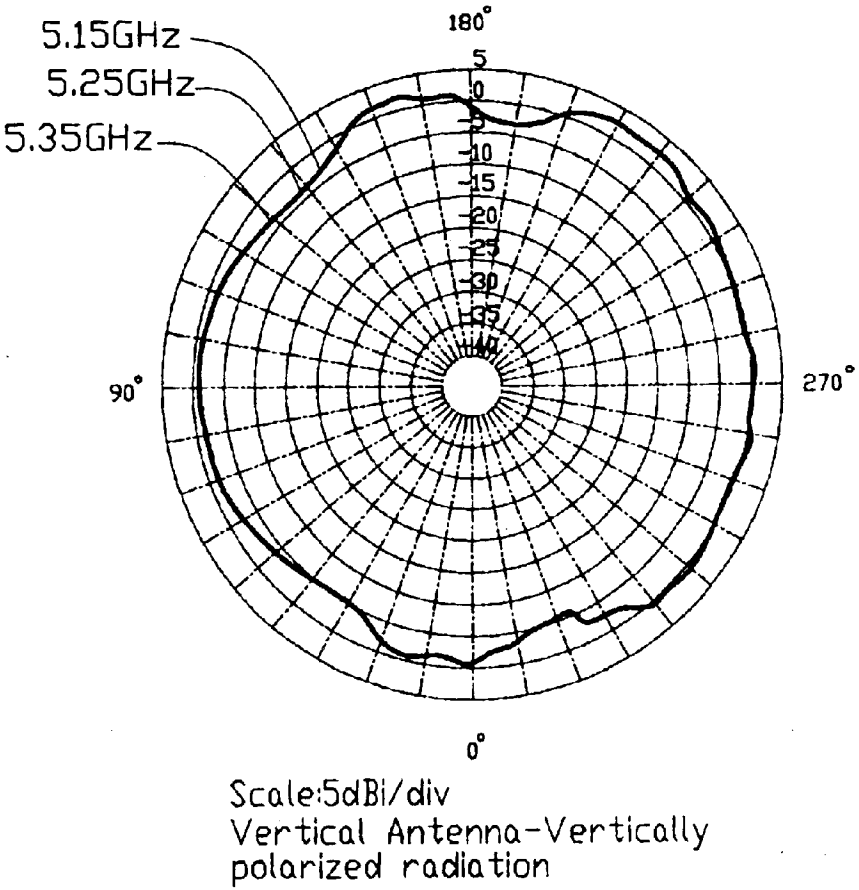
Figure 6C:
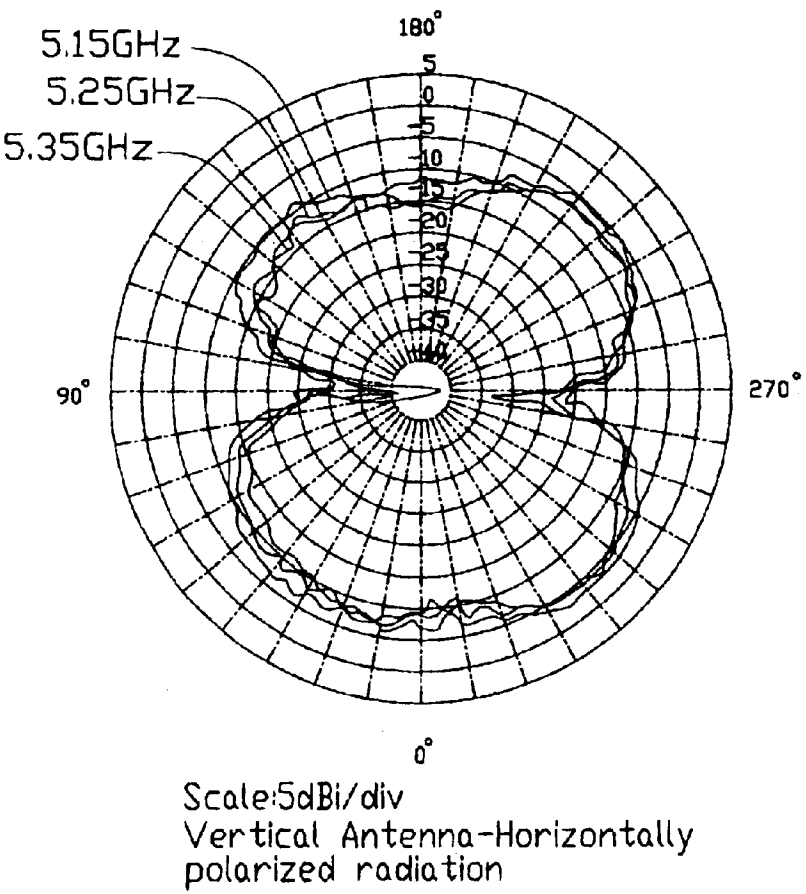
Figure 7B:
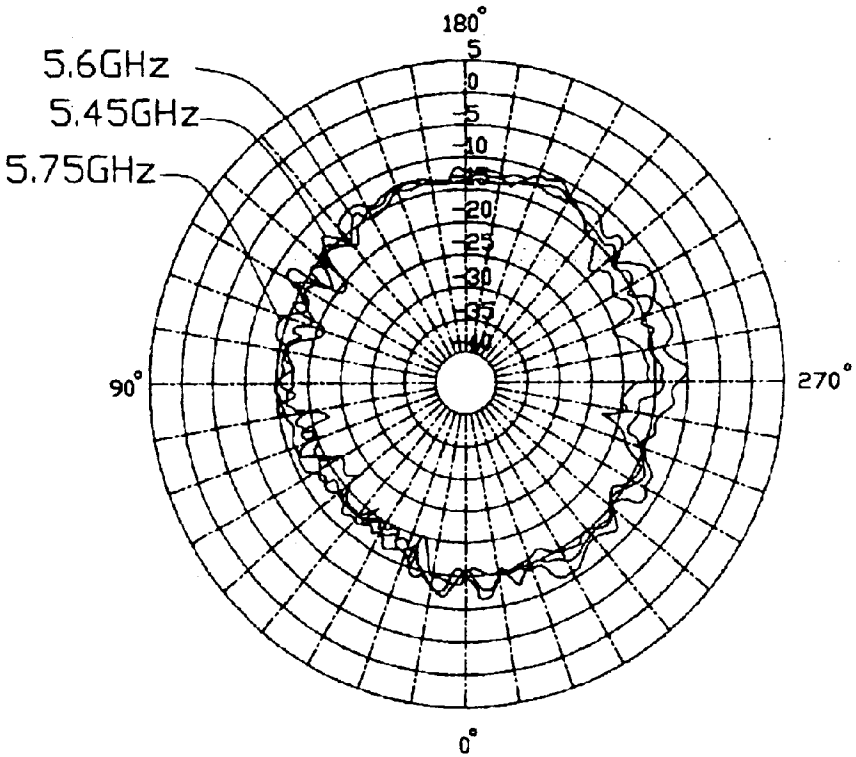
FIGS. 7A to 7D are graphs showing radiation patterns of the antenna structure of FIG. 1 operating at 5.45 GHz–5.75 GHz.
Figure 7A:
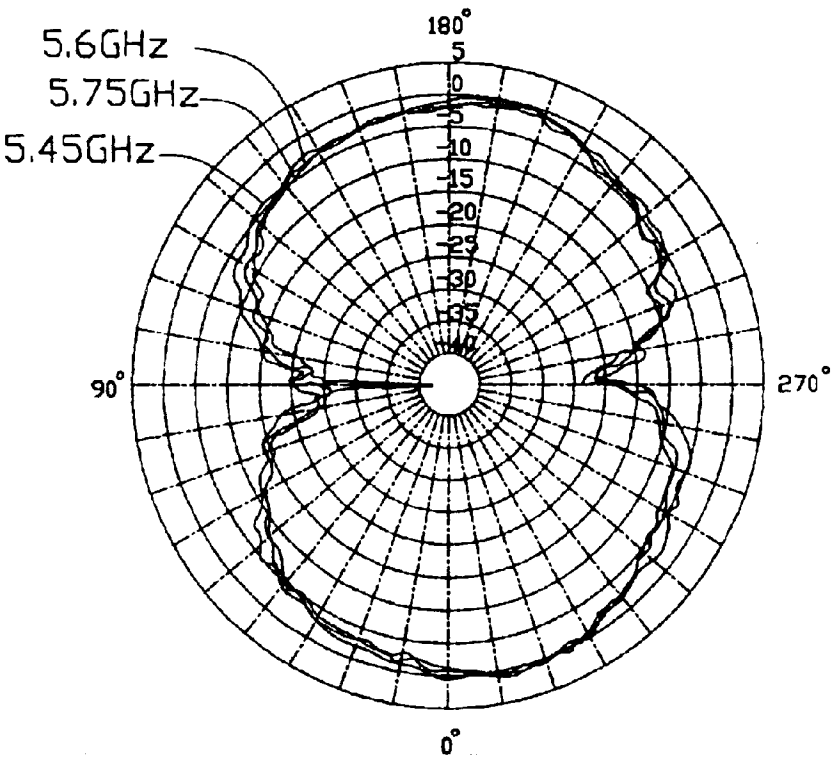
Figure 7D:
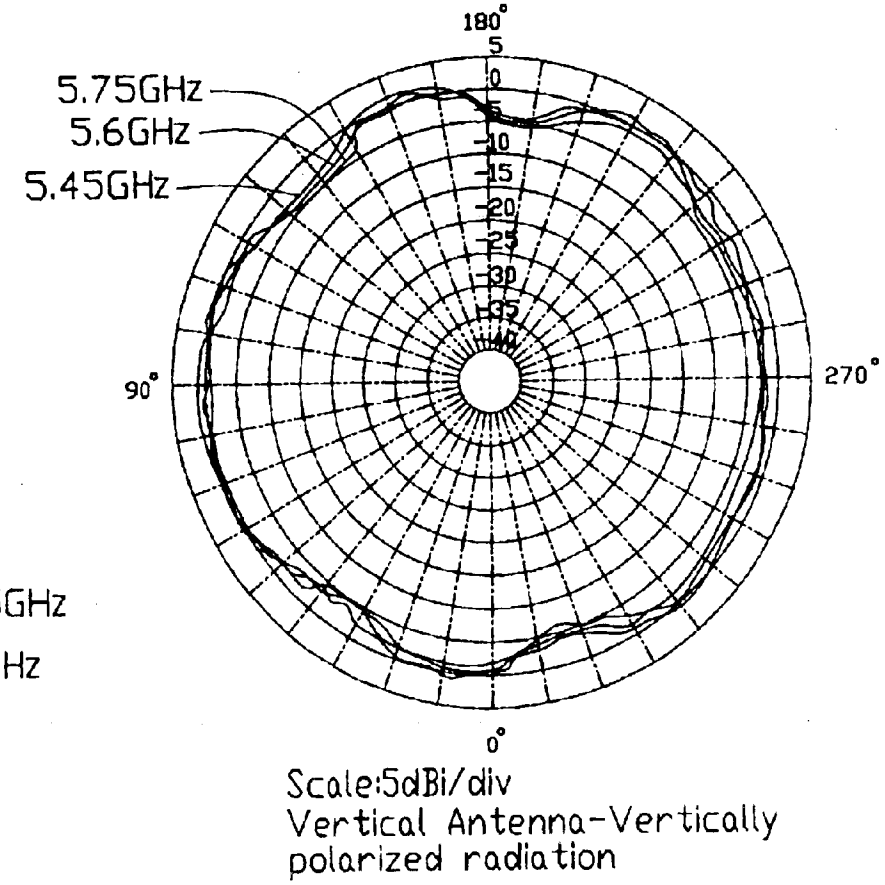
Figure 7C:
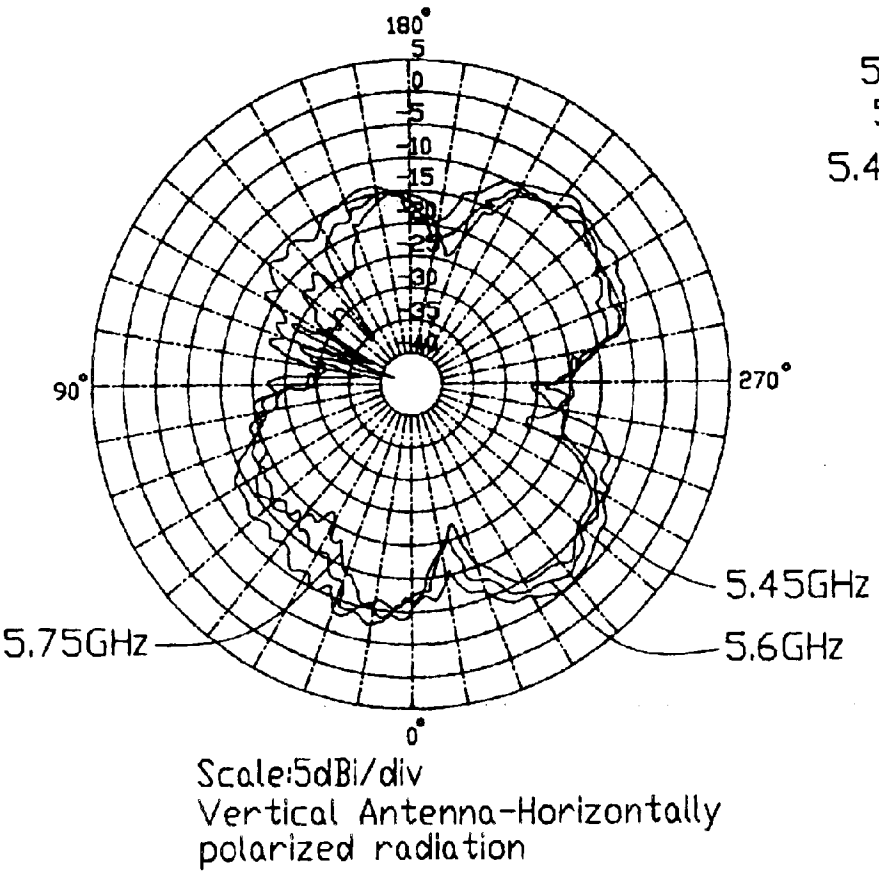

FIGS. 3 and 4 define relative orientations between the antenna structure 1 and polarized electromagnetic waves for gain testing.

FIGS. 5A–5D show, respectively, H-H, H-V, V-H and V-V relative orientation radiation patterns of the antenna structure 1, wherein the operating frequencies are chosen at 2.40 GHz, 2.50 GHz and 2.45 GHz, which are the limits and center frequency of the 2.40 GHz to 2.50 GHz frequency range for the 802.11, 802.11b, 802.11g and Bluetooth applications. As indicated in FIGS. 5A–5D, the microstrip antenna structure 1 radiates electromagnetic signals fairly onmi-directionally. Furthermore, it can be observed from FIG. 5A that the radiation fields for the H-H relative orientation are very even and the antenna gain peak values for 2.4, 2.5 and 2.45 GHz bands are −0.26 dBi, 0.32 dBi and 0.53 dBi, respectively.

Similarly, FIGS. 6A–6D and FIGS. 7A–7D show H-H, H-V, V-H and V-V relative orientation radiation patterns of the antenna structure 1, wherein the operating frequencies are chosen at 5.15 GHz, 5.25 GHz, and 5.35 GHz, and 5.45 GHz, 5.60 GHz and 5.75 GHz frequencies, which are of the 5.15 GHz to 5.35 GHz and the 5.45 GHz to 5.75 GHz frequency ranges, respectively. The results of the antenna gain over all performance are shown in FIG. 8, which indicates the excellent performance over all bands required.

Figure 9:
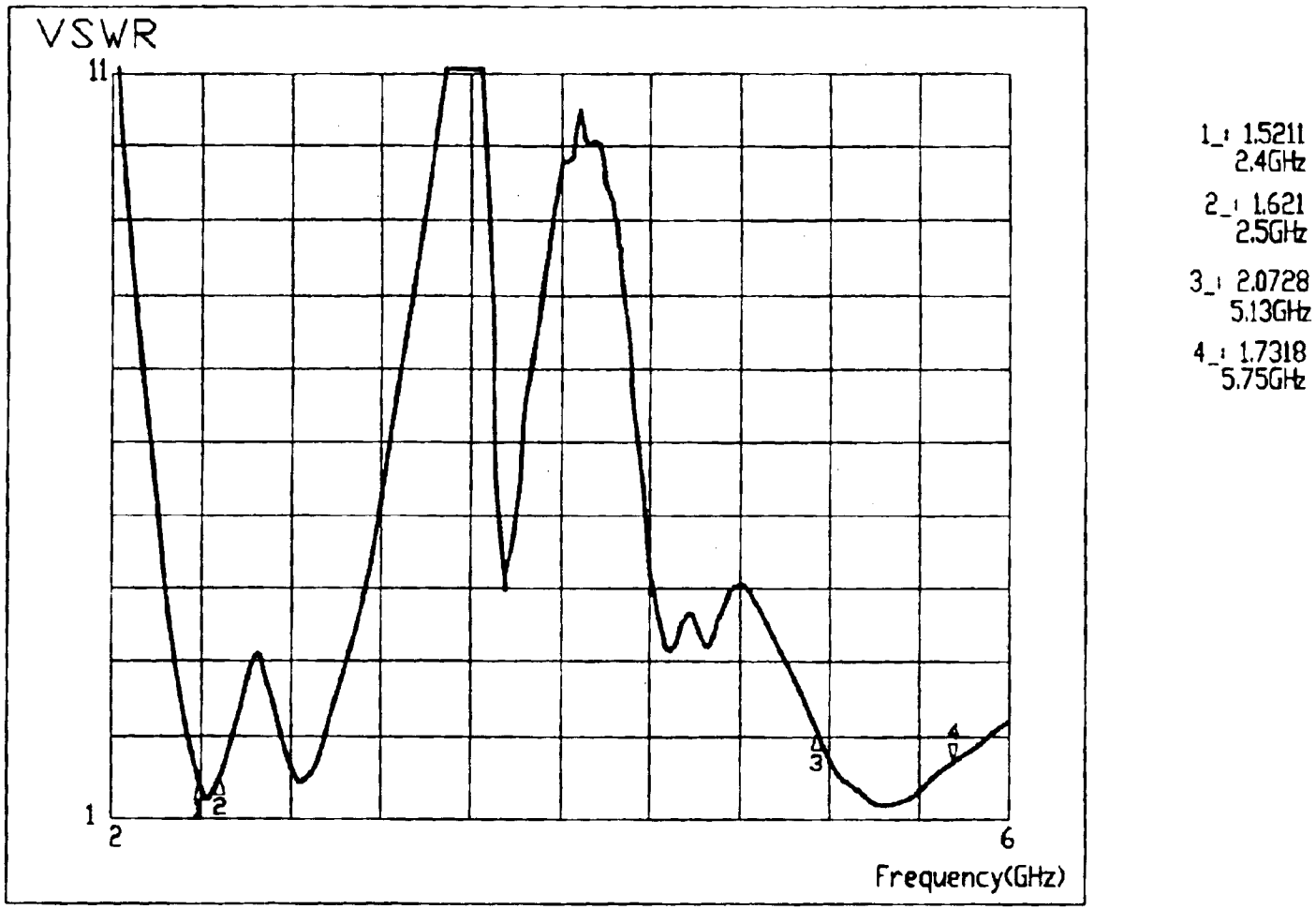
FIG. 9 is a graph showing the variation of the voltage standing wave ratio of the antenna structure of FIG. 1 as a function of frequency.

FIG. 9 displays test results of the input voltage standing wave ratio (VSWR) of the microstrip antenna structure 1 as a function of frequency. The VSWR values are near or less than 2 throughout the three bandwidths indicating acceptably efficient radiation. Both the VSWR and bandwidth results meet the requirements in the bands of 2.4–2.5 GHz, 5.15–5.35 GHz and 5.45–5.75 GHz for wireless applications.

The foregoing describes a microstrip antenna structure which is particularly well suited for applications in WLAN and Bluetooth. The use of a butterfly structure allows the antenna to provide multi-band capability, and the use of the triangular patch further allows the antenna to provide improved bandwidth over prior art antenna.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. A microstrip antenna structure comprising:

a dipole antenna including two dipole elements spaced apart from each other, each dipole element having a triangular patch and a V-shaped tentacle patch connected with the triangular patch, the triangular patch becoming wider as extending away from a connection between the triangular patch and the tentacle patch;

a feeding system connected with the dipole elements; and a substrate on which the two dipole elements are disposed.

2. The microstrip antenna structure as claimed in claim 1, wherein the two dipole elements are symmetrically disposed on the substrate.

3. The microstrip antenna structure as claimed in claim 2, wherein the two dipole elements are mirror-image of each other.

4. The microstrip antenna structure as claimed in claim 1, wherein the two dipole elements are disposed on a same surface of the substrate.

5. The microstrip antenna structure as claimed in claim 1, wherein each V-shaped tentacle patch has an angle between two arms constituting the V-shape which is predetermined to provide a matching impendence within a range of matching impedances.

6. The microstrip antenna structure as claimed in claim 1, wherein each dipole element provides a feeding point at the connection between its triangular patch and its tentacle patch, and each feeding point connects with a different conductor of the feeding system.

7. The microstrip antenna structure as claimed in claim 1, wherein the feeding system is a coaxial electric cable comprising an outer shield conductor and an inner core conductor for feeding electromagnetic signals to the two dipole elements, respectively.

8. A microstrip antenna structure comprising:

a dipole antenna including two dipole elements spaced apart from each other, each dipole element having a basic patch and a tentacle patch connected with and at least partially surrounding the basic patch, the tentacle patch having a substantially uniform width;

a feeding system including an inner core conductor connected with one of the dipole elements, and an outer shield conductor connected with the other; and a substrate on which the two dipole elements are disposed.

9. The antenna structure as claimed in claim 8, wherein said basic patch is triangular.

10. The antenna structure as claimed in claim 8, wherein said tentacle patch is V-shaped.

11. The antenna structure as claimed in claim 8, wherein said two dipole elements are mirror-image with each other.

12. The antenna structure as claimed in claim 8, wherein a pad is insulatively formed beside said two dipole elements on the substrate, and said pad extends along a direction perpendicular to a center line to which said two dipole elements are symmetrically arranged with each other.

13. The antenna structure as claimed in claim 12, wherein the outer shield conductor is electrically connected to said pad.

14. The antenna structure as claimed in claim 8, wherein a multilayer ceramic chip capacitor is provided between one of the two dipole elements and the feeding system.

15. A microstrip antenna structure comprising:

a dipole antenna including two dipole elements spaced apart from each other, each dipole element having a triangular patch and a V-shaped tentacle patch connected with the triangular patch;

a feeding system connected with the dipole elements; and a substrate on which the two dipole elements are disposed, said substrate defining a longitudinal side along a longitudinal direction and a lateral side along a lateral direction perpendicular to said longitudinal direction; wherein said V-shaped tentacle patch extends much longer than the corresponding triangular patch in both said longitudinal direction and said lateral direction;

wherein a multilayer ceramic chip capacitor is provided between one of the two dipole elements and the feeding system; and wherein tentacle patch has a substantially uniform width and at least partially surrounds the triangular patch.

16. The antenna structure as claimed in claim 15, wherein said two dipole elements are mirror-image with each other.

17. The antenna structure as claimed in claim 15, wherein the feed system comprises an inner core conductor connected with one of the dipole elements, and an outer shield conductor connected with the other.

18. The antenna structure as claimed in claim 17, wherein a pad is formed beside said two dipole elements on the substrate and is electrically connected to the outer shield conductor, and said pad extends along a direction perpendicular to a center line to which said two dipole elements are symmetrically arranged with each other.

* * * * *